US011437007B2

(12) United States Patent
Cao

(10) Patent No.: US 11,437,007 B2
(45) Date of Patent: Sep. 6, 2022

(54) SOUND-ABSORBING PIECE AND PREPARATION METHOD THEREOF

(71) Applicant: GOERTEK INC., Weifang (CN)

(72) Inventor: Xiaodong Cao, Weifang (CN)

(73) Assignee: GOERTEK INC., Weifang (CN)

( * ) Notice: Subject to any disclaimer, the term of this patent is extended or adjusted under 35 U.S.C. 154(b) by 1073 days.

(21) Appl. No.: 16/073,632

(22) PCT Filed: May 18, 2016

(86) PCT No.: PCT/CN2016/082476
§ 371 (c)(1),
(2) Date: Jul. 27, 2018

(87) PCT Pub. No.: WO2017/128562
PCT Pub. Date: Aug. 3, 2017

(65) Prior Publication Data

US 2019/0035375 A1 Jan. 31, 2019

(30) Foreign Application Priority Data

Jan. 28, 2016 (CN) ..... 201610060005.2

(51) Int. Cl.
*G10K 11/162* (2006.01)
*D04H 1/02* (2006.01)
*H04R 1/28* (2006.01)

(52) U.S. Cl.
CPC ..... *G10K 11/162* (2013.01); *D04H 1/02* (2013.01); *H04R 1/2811* (2013.01)

(58) Field of Classification Search
CPC ..... G10K 11/162; H04R 1/2811; D04H 1/02
See application file for complete search history.

(56) References Cited

U.S. PATENT DOCUMENTS 3,444,277 A * 5/1969 McMillan ..... C04B 38/08 264/43
4,420,526 A * 12/1983 Schilling ..... G10K 11/162 181/284
4,474,846 A * 10/1984 Doerer ..... D04H 1/58 442/415
5,272,000 A * 12/1993 Chenoweth ..... D04H 1/435 442/35

(Continued)

FOREIGN PATENT DOCUMENTS

CN 203984671 U 12/2014
CN 105237033 A 1/2016

(Continued)

*Primary Examiner* — Forrest M Phillips
(74) *Attorney, Agent, or Firm* — Saliwanchik, Lloyd & Eisenschenk

(57) ABSTRACT

The present invention discloses a sound-absorbing piece and a preparation method thereof. The preparation method of the sound-absorbing piece comprises: preparing perforated sound-absorbing cotton matched with a preset cavity in shape; mixing sound-absorbing material powder with a solvent and a template agent to prepare a sound-absorbing slurry; impregnating the perforated sound-absorbing cotton with the sound-absorbing slurry for a preset period; and drying the perforated sound-absorbing cotton impregnated with the sound-absorbing slurry to remove a liquid in the perforated sound-absorbing cotton.

10 Claims, 2 Drawing Sheets

(56) References Cited

U.S. PATENT DOCUMENTS

| | | | | |
|---|---|---|---|---|
| 10,633,295 | B2 * | 4/2020 | Cao | C04B 41/5024 |
| 11,168,474 | B2 * | 11/2021 | Koga | G10K 11/162 |
| 2002/0193234 | A1 * | 12/2002 | Oda | C04B 28/26 501/80 |
| 2017/0276540 | A1 * | 9/2017 | Qiu | G10K 11/162 |
| 2018/0124502 | A1 * | 5/2018 | Liu | H04R 1/2811 |

FOREIGN PATENT DOCUMENTS

| | | | |
|---|---|---|---|
| CN | 105430589 | A | 3/2016 |
| CN | 105681999 | A | 6/2016 |
| KR | 20140060269 | A | 5/2014 |

* cited by examiner

SOUND-ABSORBING PIECE AND PREPARATION METHOD THEREOF

CROSS REFERENCE TO RELATED APPLICATIONS

This application is a National Stage of International Application No. PCT/CN2016/082476, filed on May 18, 2016, which claims priority to Chinese Patent Application No. 201610060005.2, filed on Jan. 28, 2016, both of which are hereby incorporated by reference in their entireties.

TECHNICAL FIELD

The present invention belongs to the technical field of material processing and in particular relates to a sound-absorbing piece and a preparation method thereof.

BACKGROUND

At present, with increasingly demanding sound quality of a micro-speaker, a sound-absorbing material needs to be added in the micro-speaker to improve its sound effect. Nowadays, the commonly used sound-absorbing materials mainly include foamed foam and non-foamed sound-absorbing materials which perform better than the foamed foam in acoustic performance gain. The non-foamed sound-absorbing materials are usually powdered, and are granulated by those skilled in the art for use.

When such conventional processing processes as an oil-drop method and a boiling granulation method are adopted to prepare a sound-absorbing material particle, the powdered sound-absorbing material needs to cake into a particulate structure. Thus, those skilled in the art usually add a binding agent during processing to promote granulation of the powder. However, the binding agent should not be added too much because it may impact the sound-absorbing effect of the non-foamed sound-absorbing material. But if the addition of the binding agent is too low, the prepared particle is relatively lower in strength, high in probability of edge and corner emergence on appearance, and consequently, relatively lower in sphericity. This may lead to reduction of the anti-drop performance and the wear resistance of the sound-absorbing material particle. The particle may be easily powdered and even broken when working for a long time in the speaker.

Therefore, the inventor of the present invention believes that it is necessary to improve a preparation method of the sound-absorbing material particle so as to improve the performance of the sound-absorbing material particle.

SUMMARY

An objective of the present invention is to provide a novel technical solution for preparing a sound-absorbing material.

According to a first aspect of the present invention, there is provided a preparation method of a sound-absorbing piece, comprising:

preparing perforated sound-absorbing cotton matched with a preset cavity in shape;

mixing sound-absorbing material powder with a solvent and a template agent to prepare a sound-absorbing slurry;

impregnating the perforated sound-absorbing cotton with the sound-absorbing slurry for a preset period; and drying the perforated sound-absorbing cotton impregnated with the sound-absorbing slurry to remove a liquid in the perforated sound-absorbing cotton.

Optionally, the perforated sound-absorbing cotton is made from polyurethane or melamine.

Optionally, equal-proportional compression is performed on the perforated sound-absorbing cotton to ensure that the perforated sound-absorbing cotton is matched with the preset cavity in size.

Optionally, the sound-absorbing material powder is zeolite powder or white carbon black.

Optionally, cells with apertures of less than 0.5 mm account for more than 85% of all cells in the perforated sound-absorbing cotton.

Optionally, the template agent accounts for 1-35% of the sound-absorbing slurry by mass.

Optionally, the sound-absorbing slurry is doped with a binding agent, and the binding agent is inorganic silica sol or fibrous resin and accounts for 1-35% of the sound-absorbing slurry by mass.

Optionally, the sound-absorbing slurry is doped with an auxiliary, and the auxiliary is a defoamer, a coagulation accelerator or a homogenizing agent and accounts for 0.02-10% of the sound-absorbing slurry by mass.

Optionally, a drying temperature range is 40-150° C., and a drying atmosphere comprises nitrogen.

Optionally, after drying, the perforated sound-absorbing cotton is roasted, a roasting temperature range is 120-420° C., a roasting temperature rise rate is 10-80° C./h, and roasting time is 0.5-96 h.

The present invention further provides a sound-absorbing piece. The sound-absorbing piece is provided with perforated sound-absorbing cotton into which sound-absorbing material powder is adhered. The perforated sound-absorbing cotton is made from polyurethane or melamine. Cells with apertures of less than 0.5 mm account for more than 85% of all cells in the perforated sound-absorbing cotton. The sound-absorbing material powder at least comprises zeolite powder or white carbon black.

The inventor of the present invention finds that, although preparation methods of sound-absorbing material particles in the prior art have certain defects, the prepared sound-absorbing material particles have better performance in different aspects. For example, a sound-absorbing material particle prepared by one preparation method has a better sound-absorbing effect while a sound-absorbing material particle prepared by another preparation method has relatively better anti-drop performance and wear resistance. Therefore, those skilled in the art never consider improving the preparation methods of the sound-absorbing material particles but may select different preparation methods in accordance with the required performance of the sound-absorbing material particles. Thus, a technical task to be realized or a technical problem to be solved by the present invention is never thought of or expected by those skilled in the art. Besides, impregnating the sound-absorbing cotton with the sound-absorbing slurry to prepare the novel sound-absorbing piece is a method never used in the art. Hence, the present invention is a novel technical solution.

Further features of the present invention, as well as advantages thereof, will become apparent from the following detailed description of exemplary embodiments of the present invention with reference to the attached drawings.

BRIEF DESCRIPTION OF THE DRAWINGS

The drawings, which are incorporated in and constitute part of the description, illustrate embodiments of the present invention and, together with the description, serve to explain the principles of the present invention.

DETAILED DESCRIPTION

Various exemplary embodiments of the present invention will now be described in detail with reference to the accompanying drawings. It should be noted that the relative arrangement of the components and steps, numerical expressions and numerical values set forth in these embodiments do not limit the scope of the present invention unless it is specifically stated otherwise.

The following description of at least one exemplary embodiment is merely illustrative in nature and by no means is to be construed as any limitation on the present invention and its application or use.

Techniques, methods, and apparatuses known to one of ordinary skill in the relevant art may not be discussed in detail but, where appropriate, the techniques, methods, and apparatuses should be considered part of the description.

In all of the examples shown and discussed herein, any specific value should be interpreted as merely illustrative and not as a limitation. Therefore, other examples of the exemplary embodiments may have different values.

It should be noted that like reference numbers and letters represent similar terms in the following figures, and therefore, an item needs not to be further discussed in subsequent figures as soon as it is defined in a previous drawing.

Figure 1:
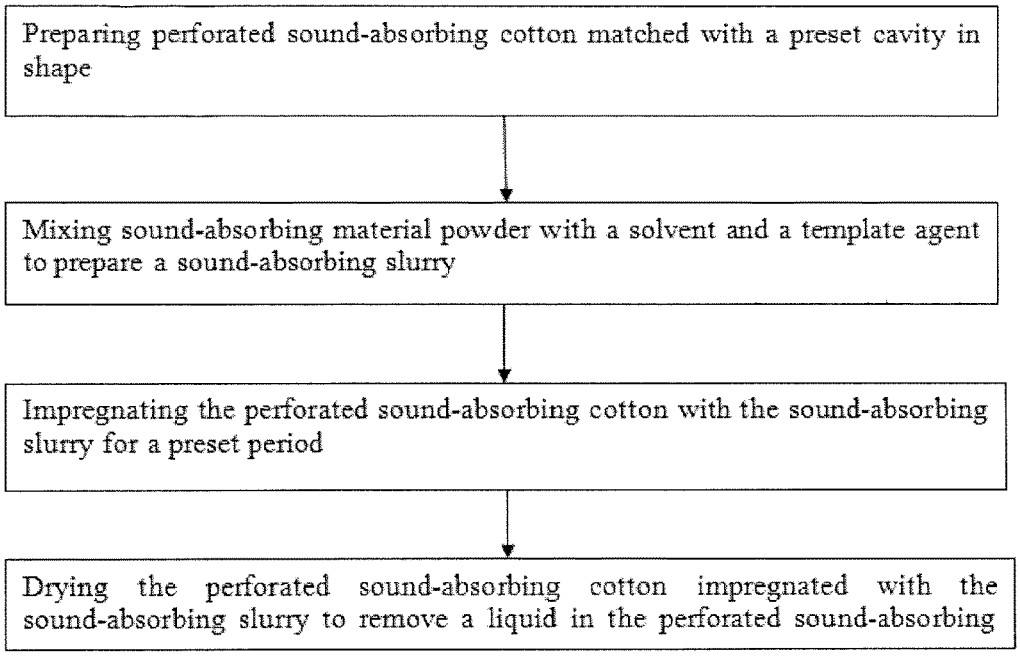
FIG. 1 is a step block diagram of a preparation method of a sound-absorbing piece, provided by the present invention.
Figure 2:
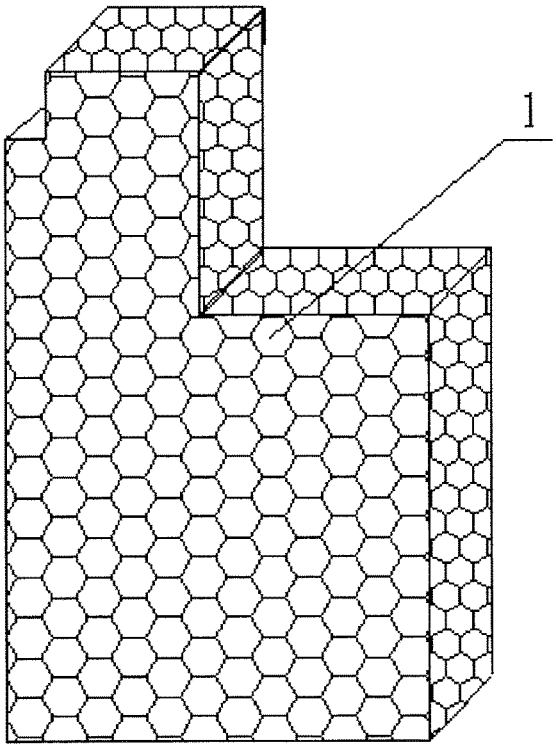
FIG. 2 is a structural schematic view of perforated sound-absorbing cotton in a specific embodiment of the present invention.
Figure 3:
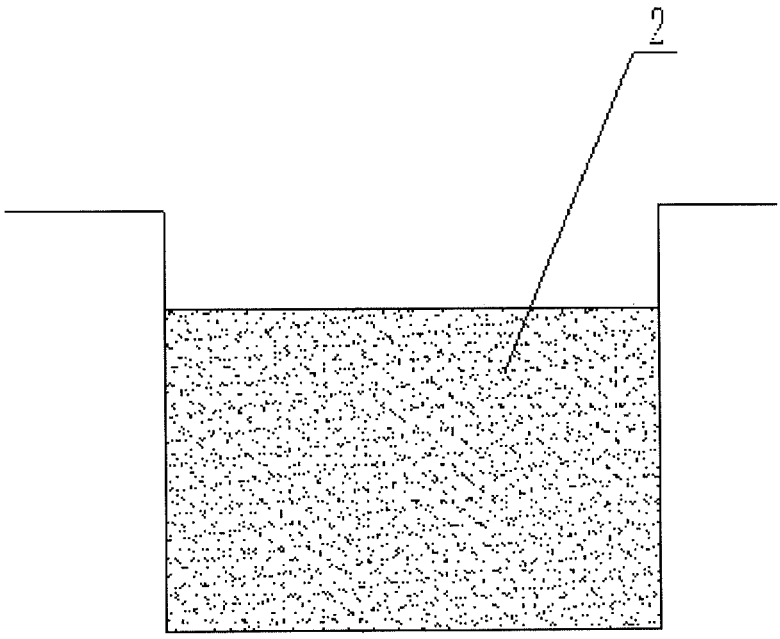
FIG. 3 is a schematic view of a sound-absorbing slurry in a specific embodiment of the present invention.

The present invention provides a novel technical solution for preparing a sound-absorbing piece. As shown in FIG. 1, a traditional foamed sound-absorbing material and a novel non-foamed sound-absorbing material are combined in the technical solution to not only provide a favorable sound-absorbing effect but also improve the anti-drop performance of the sound-absorbing piece. In a preparation method provided by the present invention, firstly, perforated sound-absorbing cotton 1 is provided. As the finally prepared sound-absorbing piece needs to be filled in a cavity of a rear cavity of a speaker module, the structure of the perforated sound-absorbing cotton 1 may be cut into a shape matched with that of a preset cavity, as shown in FIG. 2. The perforated sound-absorbing cotton 1 does not need to be exactly the same as the preset cavity in shape or size but only to be matched with the preset cavity or part of the preset cavity in shape. The size of the perforated sound-absorbing cotton 1 may be the size of the proportionally amplified preset cavity. Secondly, a slurry of the non-foamed sound-absorbing material is prepared. Crystalline powder of the sound-absorbing material may be mixed with a solvent and a template agent to prepare a sound-absorbing slurry 2, as shown in FIG. 3. Particularly, the uniformity of the sound-absorbing slurry 2 should be improved as much as possible. For example, the crystalline powder of the sound-absorbing material may be mixed with the solvent by means of quantitative dripping, atomizing adding or the like so as to improve the uniformity of the sound-absorbing slurry 2. Thirdly, the perforated sound-absorbing cotton 1 is impregnated with the sound-absorbing slurry 2 to ensure that the sound-absorbing slurry 2 may permeate the perforated sound-absorbing cotton 1. In this way, sound-absorbing material powder in the sound-absorbing slurry 2 may be uniformly adhered onto a cell skeleton of the perforated sound-absorbing cotton 1. Such conditions as impregnation time of the perforated sound-absorbing cotton and temperature of the sound-absorbing slurry during impregnation are not specifically limited by the present invention. Those skilled in the art may set these conditions in accordance with actual demands so as to achieve expected acoustic performance of the sound-absorbing piece. Fourthly, the perforated sound-absorbing cotton 1 impregnated with the sound-absorbing slurry 2 is dried to remove liquids, including the solvent, the template agent and the like, which are sucked by the perforated sound-absorbing cotton 1, to obtain the sound-absorbing piece. The sound-absorbing material powder may remain in cells of the perforated sound-absorbing cotton 1 to provide the sound-absorbing effect. Processing conditions, including the drying temperature, the drying atmosphere, the drying time and the like, may be adjusted during drying in accordance with final requirements on the acoustic performance of the sound-absorbing piece. The sound-absorbing piece prepared by the method provided by the present invention combines sound-absorbing mechanisms of the foamed sound-absorbing material and the non-foamed sound-absorbing material. The cells of the perforated sound-absorbing cotton 1 may provide an adhesion skeleton, enhance ventilation performance of the sound-absorbing piece and prevent the sound-absorbing piece from impacting sensitiveness of a speaker structure. As the non-foamed sound-absorbing material has tinier micro-channels, a favorable sound-absorbing role may be played. Besides, as the whole sound-absorbing piece takes the perforated sound-absorbing cotton 1 as a base, the sound-absorbing piece may be appropriately deformed under a drop impact to buffer an impact force, and accordingly, may not be broken or powdered.

Preferably, the perforated sound-absorbing cotton may be made from easily and uniformly foamed structures, such as polyurethane or melamine, which will not be specifically limited by the present invention and may be selected by those skilled in the art in accordance with actual situations. Particularly, the material of the perforated sound-absorbing cotton has a general foaming rule. During foaming, the bigger the single cells are, the more uniformly the cells in the perforated sound-absorbing cotton are distributed; and the smaller the single cells are, the lower the degree of distribution uniformity of the cells in the whole perforated sound-absorbing cotton is. However, in order to obtain better acoustic performance and anti-drop performance, those skilled in the art need to obtain the perforated sound-absorbing cotton, which has the small single cells and uniformly distributed cells. Thus, more preferably, during preparation of the perforated sound-absorbing cotton, perforated sound-absorbing cotton with relatively bigger and uniformly distributed cells may be prepared first and then cut into a structure of which the shape is matched with that of the preset cavity and the size is amplified in a certain proportion. At last, the cut perforated sound-absorbing cotton is integrally compressed to be consistent with the preset cavity in size. During the compression, the sizes of the cells may be uniformly reduced into appropriate sizes. The perforated sound-absorbing cotton with uniformly distributed and relatively smaller cells may be obtained through the above equal-proportional compression. In addition, the perforated sound-absorbing cotton or the proportionally compressed perforated sound-absorbing cotton may not be necessarily exactly consistent with the preset cavity in size. In accordance with requirements on the acoustic performance of a speaker, in some cases, a rear cavity of the speaker needs to be fully filled with the perforated sound-absorbing cotton, and the perforated sound-absorbing cotton needs to be exactly the same as the preset cavity in size and shape; but in other cases, only part of the rear cavity of the speaker needs to be filled with the perforated sound-absorbing cotton, and the perforated sound-absorbing cotton only needs to be the same as part of the preset cavity in size and shape.

In order to meet requirements of different speakers for the sound-absorbing piece, the perforated sound-absorbing cotton has different cell structures. Generally, the cells of the perforated sound-absorbing cotton have the apertures of less than 0.5 mm, such that the favorable adhesion skeleton may be provided for the sound-absorbing material powder. Preferably, a uniform cell aperture may provide a better sound-absorbing effect. For example, the sound-absorbing effect is much better when the cells of which the apertures are within the above aperture range account for 85% or above of the total cells. In an embodiment of the present invention, the apertures of the cells are preferably 0.18-0.22 mm, and the cells of which the apertures are within this aperture range account for 85% or above of the total cells. Thus, the finally prepared sound-absorbing piece may provide the favorable sound-absorbing effect and has a uniform damping effect in all directions.

Preferably, the sound-absorbing material powder is generally crystalline aluminosilicate powder. In some embodiments of the present invention, zeolite powder, white carbon black, a molecular sieve and the like may be independently used or mixed as the sound-absorbing material powder, which will not be specifically limited by the present invention. Other materials may also serve as the sound-absorbing material powder on the premise of providing micropores to achieve the sound-absorbing effect.

Preferably, in order to form uniform and enough micropores in the sound-absorbing material powder, the template agent has a purity of higher than 95%, and accounts for 1-35% of the sound-absorbing slurry by mass. The template agent acts on the sound-absorbing material powder when the sound-absorbing material powder is mixed with the solvent and the template agent.

Preferably, in order to increase the adhesion amount of the sound-absorbing material powder in the perforated sound-absorbing cotton, the sound-absorbing slurry may be doped with a binding agent. The binding agent may be organic silica sol, inorganic silica sol, fibrous resin or the like. Those skilled in the art may select different binding agents to be doped in the sound-absorbing slurry in accordance with actual situations. The mass ratio of the binding agent to the sound-absorbing slurry may not be too high; otherwise, permeation of the sound-absorbing slurry into the perforated sound-absorbing cotton and the sound-absorbing performance may be impacted. The mass ratio of the binding agent to the sound-absorbing slurry may not exceed 35%, and is generally kept to be 1-20%.

Preferably, the sound-absorbing slurry may be doped with an auxiliary. The auxiliary may comprise a coagulation accelerator, a defoamer, a homogenizing agent and the like, and is configured to uniformly mix a sound-absorbing raw material with the solvent so as to obtain the uniform sound-absorbing slurry with certain viscosity. More preferably, the auxiliary should account for 0.02-10% of the sound-absorbing slurry by mass. The sound-absorbing performance of the prepared sound-absorbing piece may be impacted if the consumption of the auxiliary is too high. Types of the auxiliary will not be limited by the present invention. Different types of auxiliaries may be doped in the sound-absorbing slurry by those skilled in the art according to actual situations. For example, if foam is easily produced in the process of mixing the sound-absorbing raw material with the solvent, the defoamer may be doped in the sound-absorbing slurry to eliminate the foam.

Furthermore, the drying step is used to remove the liquids including the solvent and the like, which are impregnated with the perforated sound-absorbing cotton, to form the dry sound-absorbing piece with favorable elasticity and sound-absorbing performance. Particularly, during drying, an inert gas may serve as a medium to prevent a polarity defect point in a microstructure of the sound-absorbing material powder from reacting with active molecules in the air. The inert gas may be nitrogen. In addition, an ambient temperature for drying may be appropriately increased. Optionally, a drying formed body may be placed in the inert gas with the temperature of 40-150° C. Thus, the liquids including the solvent, the template agent and the like in the perforated sound-absorbing cotton may be discharged more effectively. Those skilled in the art may adjust parameters in the drying process and correspondingly set a specific temperature curve and a drying medium in accordance with an actual application situation of the speaker structure.

Particularly, due to a relatively lower drying temperature and a relatively shorter drying time, intermolecular water molecules in the perforated sound-absorbing cotton or the sound-absorbing material powder may not be discharged. Although the dried sound-absorbing piece may be put into use, the sound-absorbing performance may not be given into full play. Thus, more preferably, the dried perforated sound-absorbing cotton is roasted, or the impregnated perforated sound-absorbing cotton is directly roasted. Since the material of the perforated sound-absorbing cotton generally has relatively lower high temperature tolerance, a roasting temperature may not be too high and may be 120-140° C. Roasting time of 0.5-96 h is permitted. Roasting at a relatively higher temperature for a relatively longer time ensures that liquid molecules and impurities in the perforated sound-absorbing cotton and the sound-absorbing material powder may be discharged, such that the acoustic performance of the sound-absorbing piece is improved. Particularly, a roasting temperature rise rate may not be too high; otherwise, the micro-channel structure of the sound-absorbing material powder and the cell structure of the perforated sound-absorbing cotton may be severely destroyed. Optionally, the roasting temperature rise rate is 20-80° C./h. The temperature rise rate of 40° C./h may be selected for roasting for 30 h when the roasting temperature is appropriately selected, for example 300° C. Thus, the liquid molecules may be basically removed. The impurities including the template agent, the auxiliary and the like are discharged. The roasting temperature, roasting time or temperature rise rate will not be accurately limited by the present invention. Those skilled in the art may adjust these parameters in accordance with actual situations. The relatively wider temperature, time and temperature rise rate ranges illustrated by the present invention cover some conditions that may be employed in particular cases.

The present invention further provides a sound-absorbing piece that is prepared by the method provided by the present invention. The sound-absorbing piece is provided with perforated sound-absorbing cotton into which sound-absorbing material powder is adhered. Cells of the perforated sound-absorbing cotton provide a multi-channel adhesion skeleton for the sound-absorbing material powder. Meanwhile, the perforated sound-absorbing cotton has a favorable elastic deformation capability and may play roles of buffering and damping. Preferably, the perforated sound-absorbing cotton is made from polyurethane or melamine. Particularly, in the perforated sound-absorbing cotton, the cells with the apertures of less than 0.5 mm account for more than 85% of the total cells. Thus, the perforated sound-absorbing cotton may provide better acoustic and mechanical properties. Furthermore, the sound-absorbing material powder at least comprises zeolite powder or white carbon black. The material of the sound-absorbing material powder or the perforated sound-absorbing cotton will not be limited by the present invention. Those skilled in the art may select other materials if the performance allows.

Although some specific embodiments of the present invention have been described in detail by way of example, those skilled in the art should understand that the above examples are only for the purpose of illustration and are not intended to limit the scope of the present invention. It will be understood by those skilled in the art that the above embodiments may be modified without departing from the scope and spirit of the present invention. The scope of the present invention is defined by the appended claims.

The invention claimed is:

1. A preparation method of a sound-absorbing piece, comprising:

preparing perforated sound-absorbing cotton matched with a preset cavity in shape;

mixing sound-absorbing material powder with a solvent and a template agent to prepare a sound-absorbing slurry;

impregnating the perforated sound-absorbing cotton with the sound-absorbing slurry for a preset period; and drying the perforated sound-absorbing cotton impregnated with the sound-absorbing slurry to remove a liquid in the perforated sound-absorbing cotton.

2. The preparation method according to claim 1, wherein the perforated sound-absorbing cotton is made from polyurethane or melamine.

3. The preparation method according to claim 1, wherein equal-proportional compression is performed on the perforated sound-absorbing cotton to ensure that the perforated sound-absorbing cotton is matched with the preset cavity in size.

4. The preparation method according to claim 1, wherein cells with apertures of less than 0.5 mm account for more than 85% of all cells in the perforated sound-absorbing cotton.

5. The preparation method according to claim 1, wherein the sound-absorbing material powder is zeolite powder or white carbon black.

6. The preparation method according to claim 1, wherein the template agent accounts for 1-35% of the sound-absorbing slurry by mass.

7. The preparation method according to claim 1, wherein the sound-absorbing slurry is doped with a binding agent, and the binding agent is inorganic silica sol or fibrous resin and accounts for 1-35% of the sound-absorbing slurry by mass.

8. The preparation method according to claim 1, wherein a drying temperature range is 40-150° C., and a drying atmosphere comprises nitrogen.

9. The preparation method according to claim 1, wherein after the drying, the perforated sound-absorbing cotton is roasted, the roasting temperature range is 120-420° C., the heating rate of the roasting is 10-80° C./h, and the roasting time is 0.5-96 h.

10. A sound-absorbing piece, wherein the sound-absorbing piece is provided with perforated sound-absorbing cotton into which sound-absorbing material powder is adhered, the perforated sound-absorbing cotton is made from polyurethane or melamine, cells with apertures of less than 0.5 mm account for more than 85% of all cells in the perforated sound-absorbing cotton, and the sound-absorbing material powder at least comprises zeolite powder or white carbon black.

* * * * *